US007678038B1

(12) United States Patent
Stieber et al.

(10) Patent No.: US 7,678,038 B1
(45) Date of Patent: Mar. 16, 2010

(54) DEVICE FOR COMPRESSING A FOLDED EDGE

(75) Inventors: Jeffrey M. Stieber, Loganville, GA (US); Kenneth A. Stein, Green Bay, WI (US); Kenneth W. Codr, New Franken, WI (US); Richard L. Goltz, Green Bay, WI (US); Gerard T. Duginske, Denmark, WI (US); Jeanne K. Hansen, Denmark, WI (US); William F. Donart, De Pere, WI (US); Jeffrey J. Ebben, Green Bay, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 5 days.

(21) Appl. No.: 11/623,235

(22) Filed: Jan. 15, 2007

(51) Int. Cl.
*B31F 1/10* (2006.01)

(52) U.S. Cl. ..... 493/442; 493/403; 493/407; 493/158; 493/64; 493/69

(58) Field of Classification Search ..... 493/403, 493/407–409, 442, 454, 158, 60, 185, 64, 493/69
See application file for complete search history.

(56) References Cited

U.S. PATENT DOCUMENTS 3,489,630 A * 1/1970 Katz et al. ..... 156/202
4,075,053 A * 2/1978 Adams ..... 156/391
4,119,246 A * 10/1978 Off et al. ..... 223/52
4,284,463 A * 8/1981 Wright ..... 156/502
4,617,073 A * 10/1986 Scott ..... 156/107
H001520 H * 3/1996 Hannula ..... 100/171
6,591,744 B2 * 7/2003 Peek ..... 100/171
6,709,375 B2 * 3/2004 Groenenberg et al. ..... 493/442
2005/0218713 A1 * 10/2005 Moshenrose ..... 301/124.1

* cited by examiner

*Primary Examiner*—Hemant M Desai
(74) *Attorney, Agent, or Firm*—Boyle Fredrickson, S.C.

(57) ABSTRACT

A compression or fold completion device used to uniformly compress a folded edge of a workpiece, such as a box blank, in order to allow the blank to more easily be utilized in subsequent packaging operations. The device includes a pressure roller mounted to a rotatable adjustment member. The rotational axis of the pressure roller is offset from the rotational axis of the adjustment member. The adjustment member is in turn connected to an actuating assembly, which may include an arm secured at one end to the adjustment member and at the other end to an extendible and retractable actuator, in order to enable the actuator to rotate the adjustment member and selectively position the pressure roller in engagement with a folded edge of a workpiece passing beneath the pressure roller.

11 Claims, 4 Drawing Sheets

DEVICE FOR COMPRESSING A FOLDED EDGE

FIELD OF THE INVENTION

The present invention relates to forming of paperboard or corrugated board, and more specifically to a machine utilized to create a folded edge in a sheet of paperboard or corrugated board.

BACKGROUND OF THE INVENTION

Corrugated or paperboard boxes or cartons are utilized to store and ship a wide variety of items. The types and sizes of corrugated or paperboard boxes vary widely in order to accommodate the types of items that are to be contained within the box.

In the formation of corrugated or paperboard boxes, a sheet of material, such as cardboard or corrugated board, is cut, scored and folded to form a collapsed box or container blank that can be erected, such as by a packaging machine or by an end user, to form the box having the desired shape. During the scoring and folding process for the box blank, a number of score lines are formed in various sections of the sheet in order to allow the portions of the sheet on opposite sides of the score line to be folded with respect to one another. When the sheet is completely formed into the collapsed box or container blank, parts of the sheet are secured to one another, such as by a suitable adhesive or by fasteners such as staples, such that the collapsed box or container blank can be quickly erected for use in containing the desired item or items within the interior of the box or container. In forming the sheet into the blank, certain areas of the sheet are folded so that the edge areas of the sheet are positioned in overlapping relationship to enable the edge areas to be secured together. With regard to the folded sections or edges of the blanks, it is desirable to maintain folded edges of uniform size in each respective blank, such that when the blanks are fit into a machine which erects the blank to package items therein, the dimensions of the folded blanks are the same.

However, due to the conventional methods utilized to form the folded edges in corrugated or paperboard blanks, the folded and scored areas of the individual blanks are often formed to have shapes, thicknesses, or other dimensions that are different from one another. The differences in the folded areas and/or edges of the blanks causes inconsistencies in or problems with the operation of the erecting machine into which the blanks are fed, because the variations in the folded edges of the blanks result in improper feeding of the box blank into the machine and/or damage to the box blank.

As a result, it is desirable to develop a machine and method which can operate to engage a folded edge formed in a blank to make the folded edge more consistent and uniform across a number of box blanks passed through the machine. It is also desirable to develop such a machine and method which can be easily integrated into a box blank forming machine as is known in the art.

SUMMARY OF THE INVENTION

According to a first aspect of the present invention, an apparatus or machine is provided which includes a roller eccentrically mounted to a support and capable of engaging a rolled, scored or folded edge on a paperboard or corrugated board blank to compress the edge, thereby making the edge more defined and uniform in shape when compared with untreated folded edges. The engaging roller is eccentrically mounted to the support using an eccentric roller positioned within the engaging roller, with the eccentric roller secured opposite the engaging roller to a pivot arm. Movement of the pivot arm causes the axis of rotation of the eccentric roller to move along an arc, and positions the engaging roller such that the engaging roller can contact a paperboard or corrugated board blank passing between the roller and a moving support surface, such as a conveyor belt. The positioning of the roller against the rolled or folded edge of the paperboard box blank functions to compress the edge into a desired dimension, thereby making the shape of the folded edge relatively uniform throughout the length of the folded edge. The pivot arm can be connected to a suitable control mechanism that is operable to selectively pivot the arm and consequently move the engaging roller between an engaging position and a disengaged or non-use position as desired, to create paperboard or corrugated board box blanks with uniform rolled or folded edges.

Numerous other aspects, features, advantages and objects of the present invention will be made apparent from the following detailed description taken together with the drawing figures.

BRIEF DESCRIPTION OF THE DRAWINGS

The drawings illustrate the best mode currently contemplated for carrying out the present invention.

In the drawings.

DETAILED DESCRIPTION OF THE INVENTION

Figure 1:
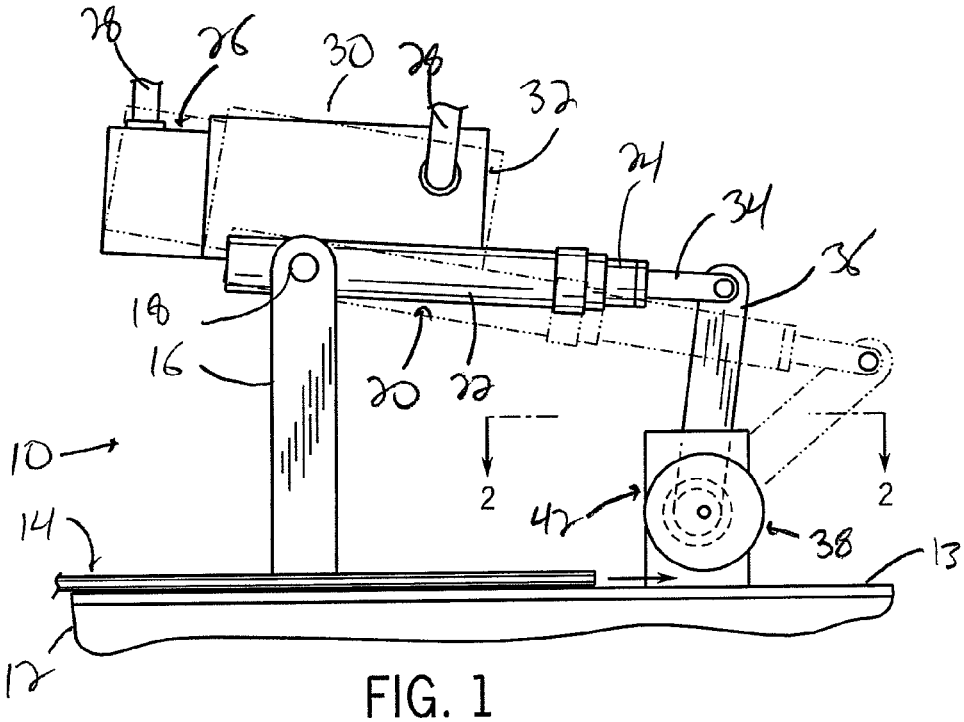
FIG. 1 a side elevation view of a fold completion device constructed according to the present invention.

With reference now to the drawing figures in which like reference numerals designate like parts throughout the disclosure, a fold completion device constructed according to the present invention is indicated generally at 10 in FIG. 1. The fold completion device 10 is well suited for use in combination with a forming assembly that includes a frame member 12 and a belt 13 that supports box blanks 14, e.g. in a machine that forms box blanks 14 from a sheet of cardboard or corrugated board material. In a known manner, box blanks 14 are advanced in a downstream direction as indicated by the arrows shown in FIGS. 1-4, such as by operation of the conveyor belt 13 or by spaced apart pairs of rollers that form successive nips to which the box blanks 14 are supplied for movement through the forming assembly, among others. After the box blanks 14 are formed in the forming assembly, the blanks are adapted to be erected into boxes (not shown), prior to placing items (not shown) into the boxes and sealing the boxes for shipment. It is understood, however, that the device 10 may be used to apply pressure to a folded area of any type of material in any type of process, and is not limited to use in the completion of a fold in a box blank. In the illustrated embodiment, the device 10 is employed to apply pressure to the folded scores or edges 15 of the folded box blanks 14 in order to compress the folded edges 15 on the box blanks 14 into a more uniform shape. By creating the uniform edges 15, the box blanks 14 can be utilized more easily in various packing lines without the problems associated with blanks 14 having non-uniform edges 15.

Figure 2:
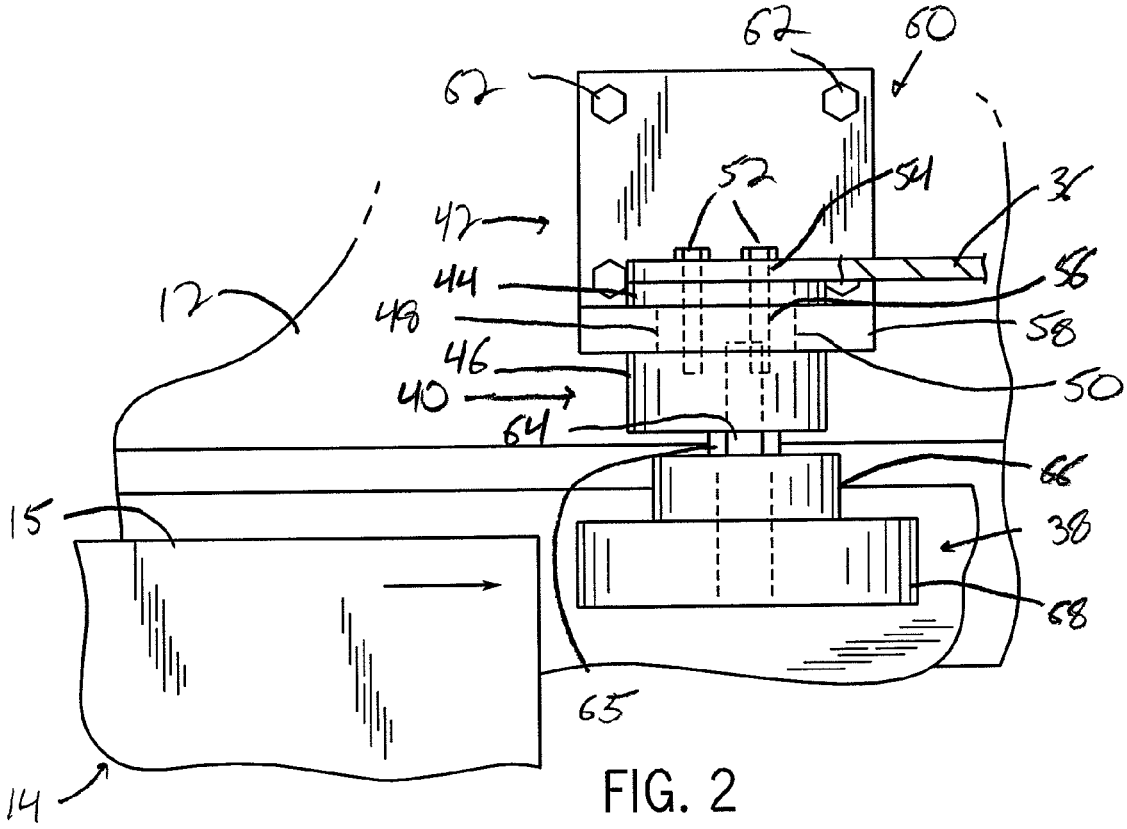
FIG. 2 is a cross-sectional view along line 2-2 of FIG. 1.
Figure 3:
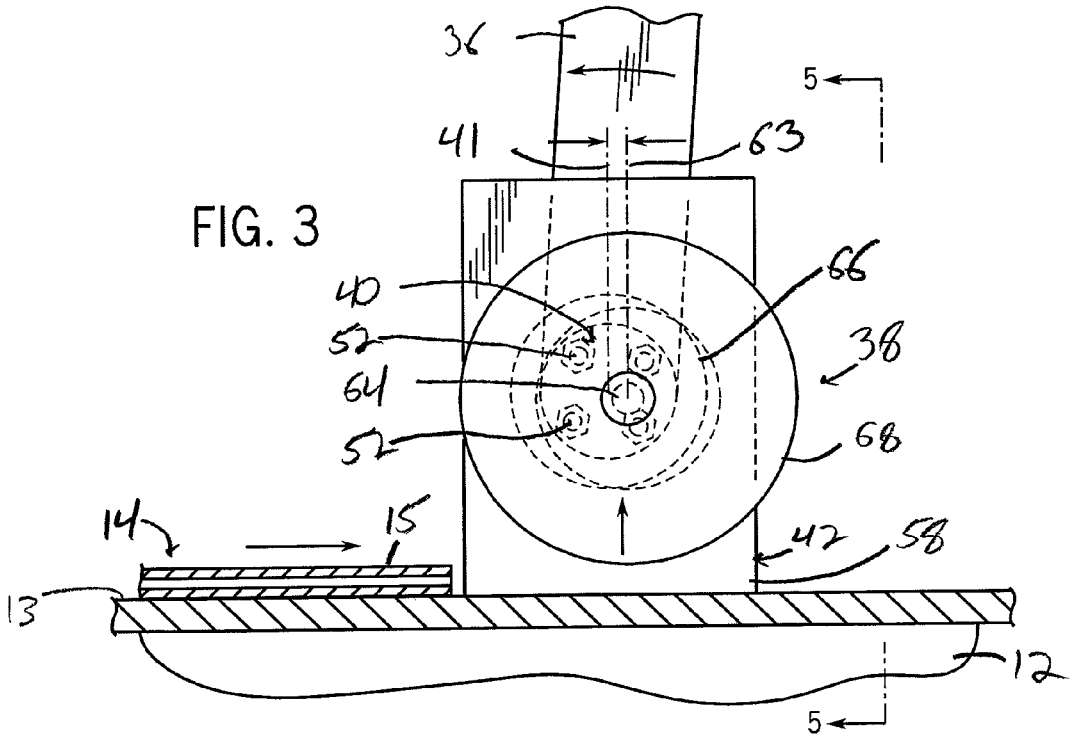
FIG. 3 is a partially broken away side elevation view of the fold completion device of FIG. 1 in a disengaged position.

Looking now at FIGS. 1 and 2, the device 10 includes a support 16 attached to one side of the frame member 12 such that the support 16 does not interfere with the operation of the conveyor in advancing the box blanks 14 in a downstream direction. The support 16 includes an aperture 18 opposite the frame member 12, within which a cylinder assembly 20 is pivotably mounted, which may be in the form of a pneumatic or hydraulic cylinder. The cylinder assembly 20 includes a housing 22 that is pivotably mounted to the support 16 via the aperture 18, and a telescoping rod 24 slidably positioned within the housing 22. A controller 26 is preferably mounted and operably connected to the housing 22 to control the operation of the cylinder assembly 20. Alternatively, the controller 26 can be mounted to a suitable surface adjacent to or spaced from the cylinder assembly 20, so long as the controller 26 remains operably connected to the cylinder assembly 20 in order to control the operation of the cylinder assembly 20. The controller 26 is employed to cause the cylinder assembly 20 to extend and retract the rod 24 relative to the housing 22 as desired, to control the operation of the entire device 10. The controller 26 can operate the cylinder assembly 20 in any suitable manner, such as by controlling the operation of a pressurizing means 30, such as a pump 32, which is connected to the cylinder assembly 20 to supply pressurized fluid to, or exhaust fluid from, the cylinder assembly 20. In an embodiment in which the controller 26 is mounted directly to the cylinder assembly 20 as shown, the controller 26 and pump 32 are connected to a number of suitable connectors, such as wires 28, that allow control signals to be sent to the controller 26 in order to operate the cylinder assembly 20 and the device 10 as desired.

Opposite the housing 22, the rod 24 includes an attachment member 34 that extends outwardly from the end of rod 24 and is pivotally attached to an actuating arm 36. The actuating arm 36 in turn is operably connected to a pressure roller 38 opposite the attachment member 34 such that the actuating arm 36 can be pivoted with respect to the rod 24 by the operation of the cylinder assembly 20, to move the pressure roller 38 toward and away from a folded box blank 14 located beneath the pressure roller 38.

Looking now at FIGS. 2-6, the actuating arm 36 is affixed to an adjustment member 40 that is rotatably secured to a roller support 42. The adjustment member 40 includes a first portion 44 disposed on one side of the roller support 42 and directly engaged with the actuating arm 36, a second portion 46 disposed adjacent the roller support 42 opposite the first portion 44, and a third portion 48 having a reduced diameter with respect to the first portion 44 and second portion 46 and extending between the first portion 44 and the second portion 46 through an aperture 50 in the roller support 42. The actuating arm 36 can be secured to one or more of the respective portions 44-48 of the adjustment member 40 by any suitable means, such as a number of mounting bolts 52 extending through openings 54 in the actuating arm 36 that are aligned with bores 56 in the adjustment member 40. Mounting bolts 52 may also serve to secure first portion 44 of adjustment member 40 to reduced diameter third portion 48. In addition, the third portion 48 of the adjustment member 40 is formed to have a diameter that is slightly less than that of the aperture 50, such that the third portion 48, and the attached first and second portions 44, 46 of the adjustment member can rotate freely with respect to the support 42.

The roller support 42 includes an upright portion 58 within which the aperture 50 is formed, and a base 60 that is secured to the conveyor frame 12, preferably by bolts 62, though other suitable means may also be utilized to secure the base 60 to the frame 12, such as welding. The base 60 may also optionally include an angle adjusting mechanism 100 (FIG. 6) disposed between separate sections 102 and 104 of the base 60 that are connected at one end via a hinge 106. The angle adjusting mechanism 100 allows the upper section 102 of the base 60 to be moved or pivoted with respect to the lower section 104 and the conveyor frame 12 about a pivot axis defined by hinge 106, such that the upper section 102 of the base 60, and consequently the roller support 42 and pressure roller 38 can be moved from a vertical position to an angled position relative to the box blanks 14 passing beneath the roller 38. This enables the pressure roller 38 to apply pressure in a different form or degree to the folded edge 15 of a box blank 14 passing beneath the pressure roller 38 on the conveyor belt 13.

Referring again to FIGS. 2-6, a support shaft 64 extends outwardly from the second portion 46 of the adjustment member 40 opposite the actuating arm 36 and provides an attachment point for the adjustment member 40 to the pressure roller 38. The shaft 64 is fixedly secured to the adjustment member 40 in an offset or eccentric configuration, such that the longitudinal centerline 63 of the shaft 64 is spaced from the centerline 41 of the adjustment member 40.

Opposite the adjustment member 40, the pressure roller 38 is rotatably affixed to the shaft 64 and preferably separated from the adjustment member 40 by a bearing 65 formed of a suitable material. The pressure roller 38 includes an inner section 66 to which is mounted an outer section 68, which has a diameter greater than that of the inner section 66. The outer section 68 forms the engaging portion of the pressure roller 38 that physically contacts the folded edges 15 of the box blanks 14 passing beneath the pressure roller 38. In one embodiment, the outer section 68 is fixed to the inner section 66, such that the outer section 68 and inner section 66 each rotate around the shaft 64. However, the outer section 68 can also be rotatably mounted to the inner section 66, such as by a suitable bearing means (not shown) such that the outer section 68 freely moves with respect to the inner section 66. In this embodiment, the inner section 66 is fixedly mounted to the shaft 64 to prevent rotation of the inner section 66. In addition, the outer section 68 is preferably formed of a solid material, such that other than a bore or aperture (not shown) utilized for securing the inner section 66 to the outer section 68, the outer section 68 has a mass that assists in effectively compressing the folded edge 15 of the blank 14 passing beneath the outer portion 68 of the roller 38.

Figure 4:
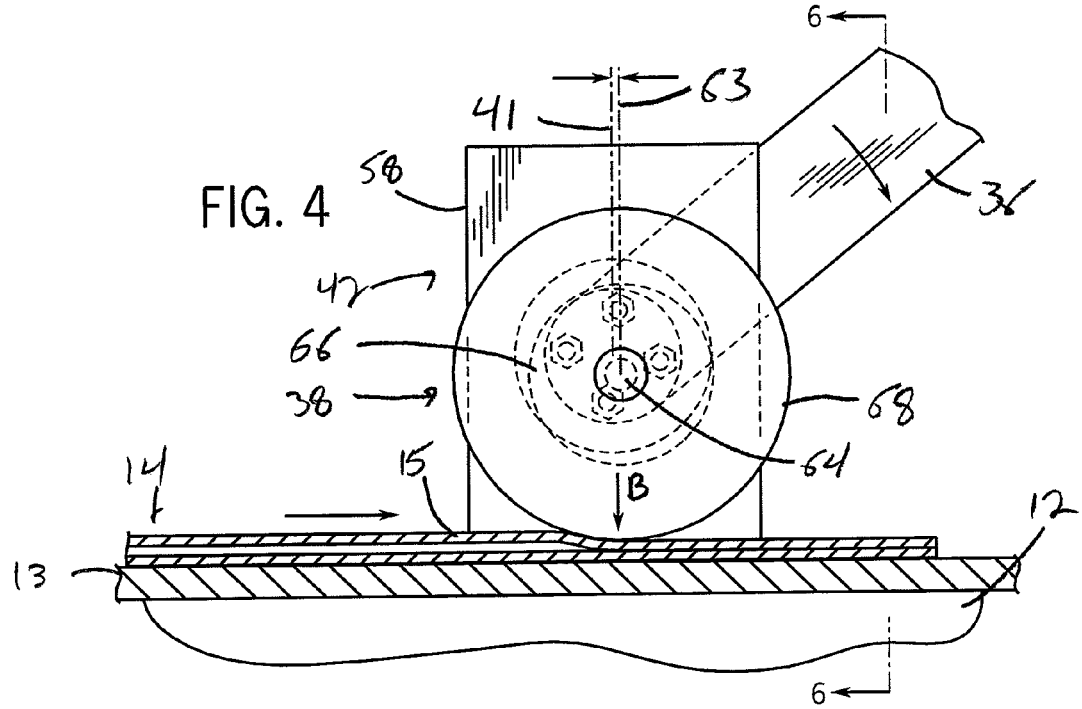
FIG. 4 is a partially broken away side elevation view of the fold completion device of FIG. 1 in an engaged position.
Figure 5:
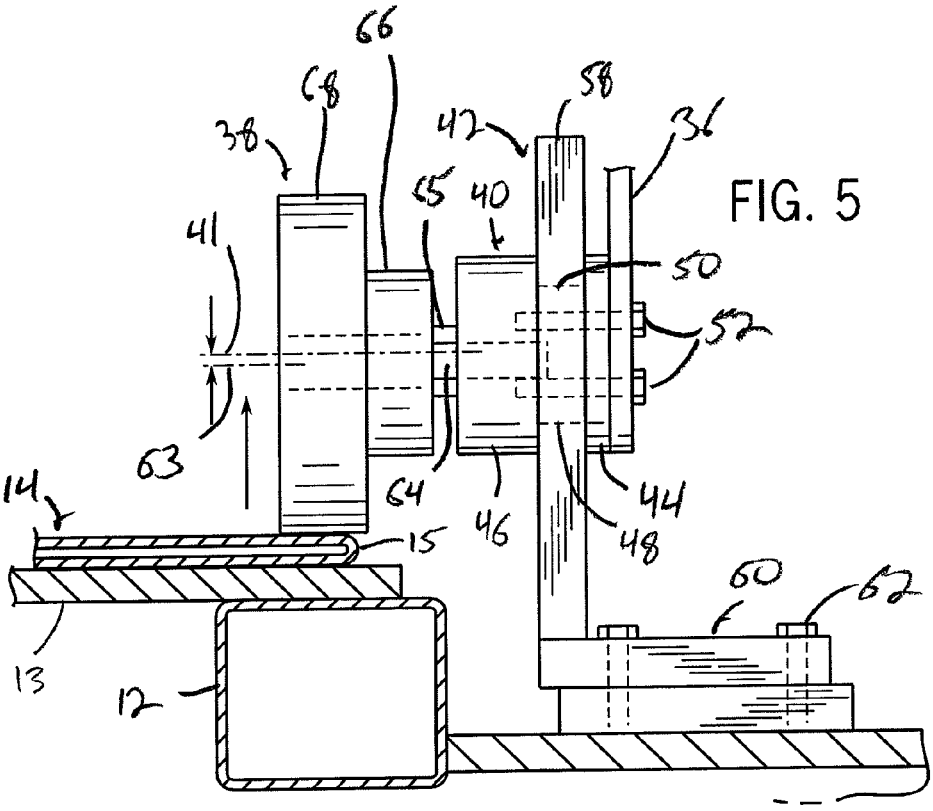
FIG. 5 is a cross-sectional view along line 5-5 of FIG. 3.
Figure 6:
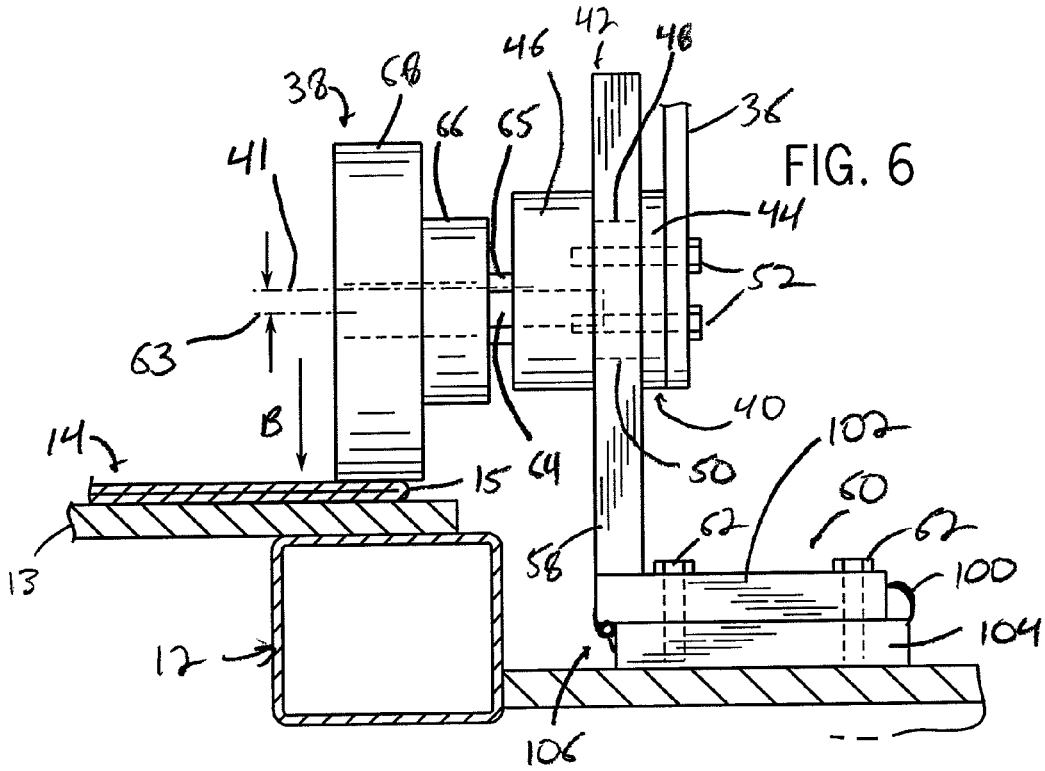
FIG. 6 is a cross-sectional view along line 6-6 of FIG. 4.

In operation, a box blank 14 with a folded edge 15 is moved along conveyor frame rail 12 by the conveyor belt 13 toward the fold completion device 10. Prior to the box blank 14 reaching the device 10, the telescoping rod 24 of the hydraulic cylinder assembly 20 is moved relative to the housing 22 by operation of the controller 26, such that the adjustment member 40 and support shaft 64 are positioned in a manner that positions the outer section 68 of the pressure roller 38 at a desired distance from the surface of rail 12 to provide a desired degree of pressure on the folded edge 15 of the blank 14. The position of pressure roller 38 is selected based on the incoming thickness of the folded blank 14 at folded edge 15 and the desired pressure to be applied to the folded edge 15. As the folded edge 15 of the box blank 14 moves beneath the pressure roller 38, the controller 26 operates the hydraulic cylinder assembly 20 to maintain the desired degree of pressure on folded edge 15, by constantly operating cylinder assembly 20 such that the end of the actuating arm 36 opposite the roller support 42 is pushed forward, which pivots the lower end of the arm 36 with respect to the support 42 and rotates the adjustment member 40 and support shaft 64 relative to the roller support 42. This function to position the longitudinal axis 63 of the support shaft 64 lower with respect to the roller support 42, by moving the outer section 68 of the pressure roller 38 downwardly, as indicated by arrow B in FIGS. 4 and 6, to engage the outer section 68 of the pressure roller 38 with the folded edge 15 of the box blank 14. As the box blank 14 moves beneath the outer section 68 of the pressure roller 38 in the lowered position, the pressure roller 38 compresses the folded edge 15 of the box blank 14, as best shown in FIG. 4. Due to the solid construction of the outer portion 68 of the roller 38, and the position of the roller 38 with respect to the folded edge 15, the outer portion 68 of the roller 38 applies a relatively constant amount of pressure 38 to the folded edge 15 in a manner that creates a relatively uniform creased, scored or folded edge 15 on the box blank 14.

If desired, the controller 26 can be operated to raise or lower the outer section 68 of the pressure roller 38, to adjust for different thicknesses of material and/or for a different amount of pressure to be applied to the folded edge 15.

Figure 7:
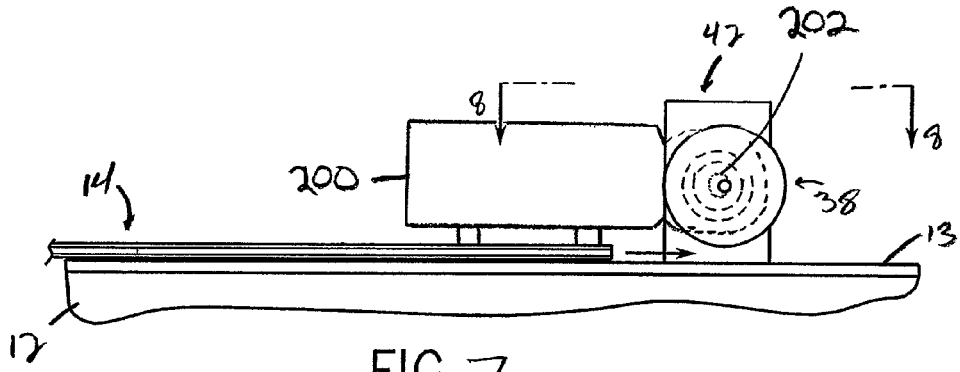
FIG. 7 is a side elevation view of a second embodiment of the device of FIG. 1.
Figure 8:
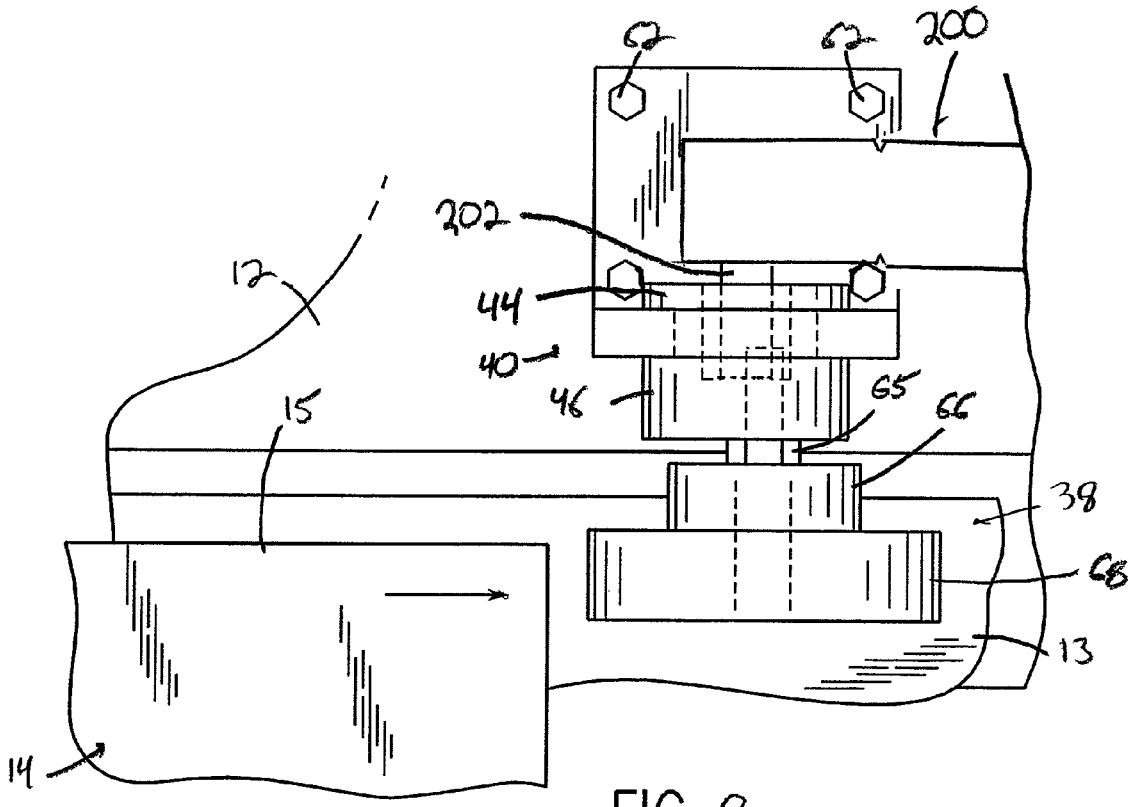
FIG. 8 is a cross-sectional view along line 8-8 of FIG. 7.

While the invention has been shown and described with respect to completing the fold in a creased box blank, it is contemplated that the invention may be utilized in any other application in which it is desired to complete a fold in any type of material for any type of use. It is also considered that two or more devices 10 can be used in conjunction with one another to more uniformly compress the blanks 14 or to compress the blanks 14 in a step-wise manner prior to the blanks 14 entering the packaging machine. Also, the pressure roller 38 can be formed to have a unitary construction, without an inner section 66, and can be driven by a suitable motor (not shown) as opposed to being freely rotatable with respect to the support shaft 64. It is also contemplated that rotational movement of the adjustment member 40 relative to the support 42 may be accomplished using an actuating mechanism other than cylinder assembly 20 and actuating arm 36, e.g. in order to save space if required for a particular installation. Such an alternative construction could employ any satisfactory actuating device that is capable of providing controlled rotational movement of adjustment member 40 to a desired position and maintaining adjustment member 40 in position in order to apply a desired degree of pressure on the blank 14 or other workpiece. For example, referring now to FIGS. 7 and 8, the device 10, instead of the cylinder assembly 20, could employ a small motor 200 having a rotatable output shaft 202 secured to the adjustment member 40. When the motor 200 is operated utilizing a suitable controller (not shown) to rotate the shaft 202, the rotation of the shaft 202 is transferred directly to the adjustment member 40 to consequently move the pressure roller 38 either into or out of engagement with the box blank 14, depending upon the rotation direction of the shaft 202 as caused by the motor 200.

Various alternatives are contemplated as being within the scope of the following claims particularly pointing and distinctly claiming the subject matter regarded as the invention.

What is claimed is:

1. A device for compressing a folded edge of a workpiece, the device comprising:

a support surface for supporting the workpiece;

a rotatable pressure application member spaced from the support surface by a fixed distance, wherein the rotatable pressure application member is rotatable about a first axis of rotation, and wherein the workpiece passes through a space defined by the fixed distance between the support surface and the rotatable pressure application member such that a folded edge defined by the workpiece is compressed by operation of the support surface and the rotatable pressure application member as the folded edge of the workpiece passes through the space defined between the support surface and the rotatable pressure application member; and an adjustment mechanism interconnected with the rotatable pressure application member, wherein the adjustment mechanism is configured to adjust the fixed distance defined between the support surface and the rotatable pressure application member, wherein the adjustment mechanism includes a rotatable support member to which the pressure application member is rotatably mounted, and an actuator interconnected with the rotatable support member for selectively imparting rotation to the rotatable support member, wherein the rotatable support member is rotatable about a second axis of rotation that is offset from and parallel to the first axis of rotation such that selective rotation of the rotatable support member caused by operation of the actuator is operable to adjust the fixed distance defined between the support surface and the rotatable pressure application member due to the offset between the first and second axes of rotation, and wherein the space defined by the fixed distance between the support surface and the rotatable pressure application member remains constant other than during operation of the actuator to impart rotation to the rotatable support member.

2. The device of claim 1 wherein the pressure application member comprises a pressure roller.

3. The device of claim 1 wherein the support member comprises a support shaft connected to the actuator at one end and to the pressure application member at an opposite end, wherein a longitudinal axis of the support shaft defines the first axis of rotation about which the pressure application member is rotatable.

4. The device of claim 1 wherein the actuator comprises a motor including a rotatable output shaft operably connected to the support member.

5. The device of claim 1 wherein the actuator comprises an extendible and retractable cylinder assembly including a housing and a telescoping member interconnected with the support member.

6. The device of claim 5 wherein the cylinder assembly is operably connected to a controller for controlling the position of the telescoping member relative to the housing.

7. The device of claim 5 further comprising an actuating arm operably connected between the telescoping member and the adjustment member.

8. The device of claim 7 wherein the pressure application member includes a pressure roller and wherein the actuating arm is secured to the rotatable support member, wherein movement of the actuating arm functions to control the position of the pressure application member through the rotatable support member.

9. The device of claim 1 wherein the pressure application member includes an inner member affixed to the support member, and an outer member interconnected with the inner member.

10. The device of claim 9 wherein the outer member is formed as a solid block of material.

11. The device of claim 9 wherein the outer member is rotatable relative to the inner member.

* * * * *